US008757288B2

(12) United States Patent
Heinzelmann et al.

(10) Patent No.: US 8,757,288 B2
(45) Date of Patent: Jun. 24, 2014

(54) HANDHELD WORK APPARATUS HAVING AN ELECTRIC DRIVE MOTOR

(75) Inventors: Georg Heinzelmann, Winnenden (DE); Andreas Binder, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 183 days.

(21) Appl. No.: 13/229,869

(22) Filed: Sep. 12, 2011

(65) Prior Publication Data

US 2012/0067608 A1 Mar. 22, 2012

(30) Foreign Application Priority Data

Sep. 18, 2010 (DE) ..... 10 2010 045 993

(51) Int. Cl.
*E21B 41/00* (2006.01)
*B25F 5/02* (2006.01)

(52) U.S. Cl.
CPC ..... *B25F 5/02* (2013.01)
USPC ..... 173/217; 173/216; 30/381

(58) Field of Classification Search
USPC ..... 173/216, 217; 30/215, 216, 298, 223, 30/277.1, 386, 381, 387
See application file for complete search history.

(56) References Cited

U.S. PATENT DOCUMENTS

| | | | | |
|---|---|---|---|---|
| 4,483,072 | A * | 11/1984 | Nagashima et al. | 30/381 |
| 4,930,583 | A * | 6/1990 | Fushiya et al. | 173/109 |
| 6,511,770 | B2 * | 1/2003 | Chang | 429/100 |
| 2005/0058890 | A1 * | 3/2005 | Brazell et al. | 429/99 |
| 2009/0126964 | A1 | 5/2009 | Schroeder et al. | |
| 2010/0218385 | A1 * | 9/2010 | Mang et al. | 30/216 |
| 2010/0218967 | A1 * | 9/2010 | Ro kamp et al. | 173/217 |

* cited by examiner

*Primary Examiner* — Thanh Truong
*Assistant Examiner* — Nathaniel Chukwurah
(74) *Attorney, Agent, or Firm* — Walter Ottesen P.A.

(57) ABSTRACT

A handheld work apparatus having an electric drive motor has a battery pack (11) serving as a power supply unit for the drive motor. A receptacle for the battery pack (11) is provided on a housing (2) of the work apparatus. In order to simplify the mounting and arrange the battery pack (11) in a more favorable manner, a receiving compartment is provided in the housing (2) and a system carrier is arranged therein, to which electrical components (12, 13, 16) and electrical lines are affixed. A battery compartment (6) is formed in the system carrier (5) and contact elements for contacting the battery pack (11) are arranged on the system carrier (5). The electrical components (12, 13, 16) are interconnected and connected to the contact elements (18) by the lines located on the system carrier (5).

17 Claims, 6 Drawing Sheets

HANDHELD WORK APPARATUS HAVING AN ELECTRIC DRIVE MOTOR

CROSS REFERENCE TO RELATED APPLICATION

This application claims priority of German patent application no. 10 2010 045 993.3, filed Sep. 18, 2010, the entire content of which is incorporated herein by reference.

FIELD OF THE INVENTION

The invention relates to a handheld work apparatus having an electric drive motor.

BACKGROUND OF THE INVENTION

A large number of handheld work apparatus, which have an electric motor as the drive motor and in which a battery pack serves as the power supply unit, are known. One such work apparatus is described, for example, in United States patent application publication 2009/0126964 A1. The battery pack can be fastened on a receiving arrangement on account of the simple interchangeability amongst other reasons. This involves attaching the battery pack on the lower end of the handle, with a region having electric contacts projecting into the handle.

Such an arrangement is advantageous in various types of apparatus but is impractical in other apparatus because an attached battery can impair handling.

SUMMARY OF THE INVENTION

It is an object of the invention to provide a handheld work apparatus having an electric drive motor of the type described above in which the electric components are assembled in a simple manner and the battery pack is arranged in a more favorable manner.

The handheld work apparatus of the invention includes: an electric drive motor; a battery pack configured as a power supply unit for the drive motor; a housing having a receiving space; a receiver arranged on the housing and being configured to receive the battery pack; a system carrier arranged in the receiving space; a plurality of electrical components attached to the system carrier; a plurality of electrical lines attached to the system carrier; the system carrier having a battery compartment formed therein; a plurality of contact elements arranged on the system carrier and being configured to contact the battery pack; and, the electrical lines being configured to interconnect the electrical components and connect the same with the contact elements.

With the present invention, the electric components are combined on a system carrier and are inserted as a module into the housing of the work apparatus, as a result of which the assembly is substantially simplified. The functionality of the module can already be tested before mounting in the housing so that faults can be determined early and rectified. Further, it is advantageous that the battery pack can be accommodated entirely in the housing of the work apparatus and does not protrude in a disruptive manner at any point.

In a preferred configuration of the invention, the battery compartment or battery shaft is formed between two parallel walls or wall segments of the system carrier which protrude from a base, the base together with the walls or wall segments having a U-shape. As a result of this configuration, the shape of the battery compartment or battery shaft is sufficiently defined with minimal use of the material for the system carrier. According to a further configuration, a rim which surrounds an insertion opening of the battery compartment is arranged on those ends of the wall segments which face away from the base. Such a configuration is advantageous when the system carrier is arranged in a housing which does not delimit the battery compartment laterally, so that the rim provides a lateral guide for the battery pack.

The system carrier is preferably of plastic and is configured in one piece as an injection molded part. The receptacles for the electric components and also for the electrical lines can be provided on this injection molded part, so that the greatest possible integration is possible. It is also expedient that guide ridges, which form a gap between the battery pack and the walls, are arranged on the sides that face each other of the walls which delimit the battery compartment. In this manner, the battery pack can also be cooled with a corresponding guidance and conductance of a cooling air flow within the housing.

In order to prevent an unintended detachment of the battery pack from the system carrier, it is advantageous to provide, on those ends of the wall segments which are remote from the base, retaining elements for fixing the battery pack. The electrical components include preferably at least one electronic controller or regulator and a switching device or a switch. The switching device in this case advantageously includes a controllable resistor so that the voltage to be supplied can be varied. The electronic controller provides for optimal operation of the electric motor in consideration of the particular parameters. An electronic regulator can be provided instead of the control.

Furthermore, it is advantageous that the electrical lines are bundled to form a cable harness which is at least partially arranged in recesses in the system carrier. A prefabricated cable harness simplifies assembly and can be held in the recesses in the system carrier in a simple manner. Furthermore, it is practical to provide on the system carrier electrical lines having connections for connecting to the drive motor. The system carrier with all its electrical components is inserted into the housing of the work apparatus so that subsequently only the connection to the drive motor with the assistance of the connecting terminals still has to be undertaken.

In order that the electrical components do not each have to be attached individually to the system carrier, it is seen as advantageous that a carrier plate is provided on the system carrier on which the electronic controller and connecting plugs and also, where applicable, further components are arranged. In this manner, the electrical components can be combined to form a module which is then fixed on the system carrier and connected to the contact elements.

In particular types of work apparatus, safety arrangements have to be provided in order to protect operators from danger in certain handling situations. In such apparatus, it is practical that the electrical components also include a switch which interrupts the power supply when a hand guard is actuated.

In order to avoid damage to the contact elements and to ensure a secure contacting of the battery pack, it is also suggested that the contact elements for contacting the battery pack are arranged on the base of the battery compartment, preferably on a contact plate that is mounted in a floating manner.

In particular types of work apparatus, it can be practical to provide a rear handle on the housing of the work apparatus and to mount a throttle lever therein, which is mechanically connected to the switching device. In this manner, the power which is in each case desired of the drive motor can be set with the aid of the throttle lever. In order to arrange a switch on the system carrier, it can be practical to provide on the rim a receiving arrangement for the switch. In order to fix the system carrier in the housing, which provides a substantially larger installation space than is required for the system carrier, it can be practical that supports are formed on the rim, fixing eyelets for receiving fastening elements being located on the free ends of said supports. For easier removal of the battery pack from the system carrier, it is advantageous that a push-out arrangement is arranged on the base of the battery compartment. Such a push-out arrangement can be provided, for example, in the form of spring loaded wire brackets.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
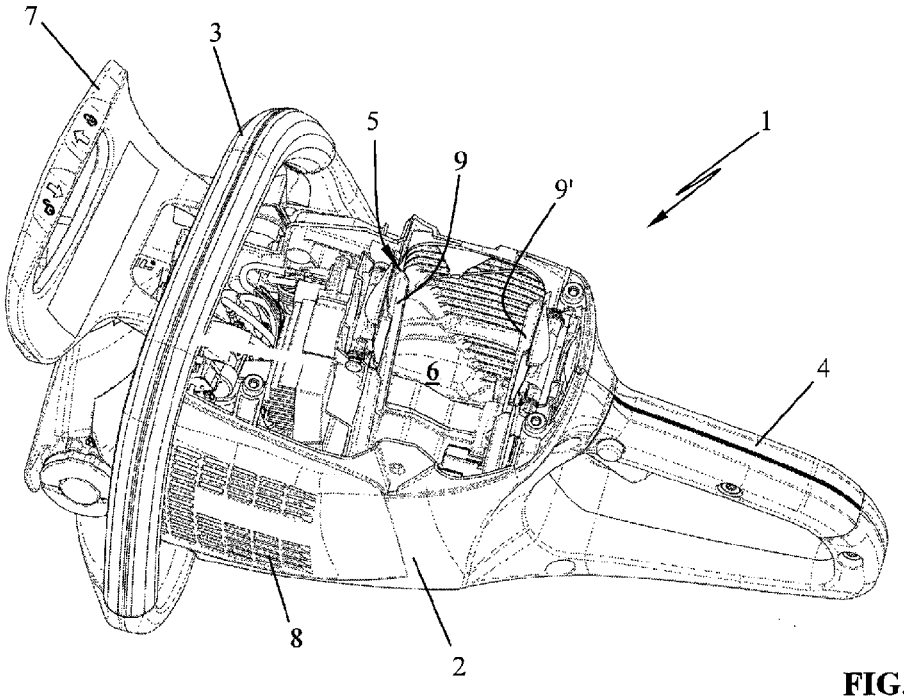
FIG. 1 shows a perspective view of a chain saw having the upper housing cover removed.

The embodiment in FIG. 1 shows a chain saw 1 in a perspective view from above, wherein an electric drive motor, which cannot be seen in FIG. 1, is arranged in a housing 2. A front bale handle 3, which extends over the housing 2, and a rear handle 4 are arranged on the housing 2. The housing 2 has a plurality of air inlet openings 8, through which the cooling air can be drawn into the housing. Provided in the housing 2, adjacent to the rear handle 4, is a receiving space in which there is mounted a system carrier 5 on which there are arranged a plurality of switch elements and control elements which are described in more detail below, the receiving space also having a battery compartment 6 for a battery pack, which is formed between two essentially parallel vertical walls (9, 9'). A hand guard 7 is provided in the front region of the housing 2.

Figure 2:
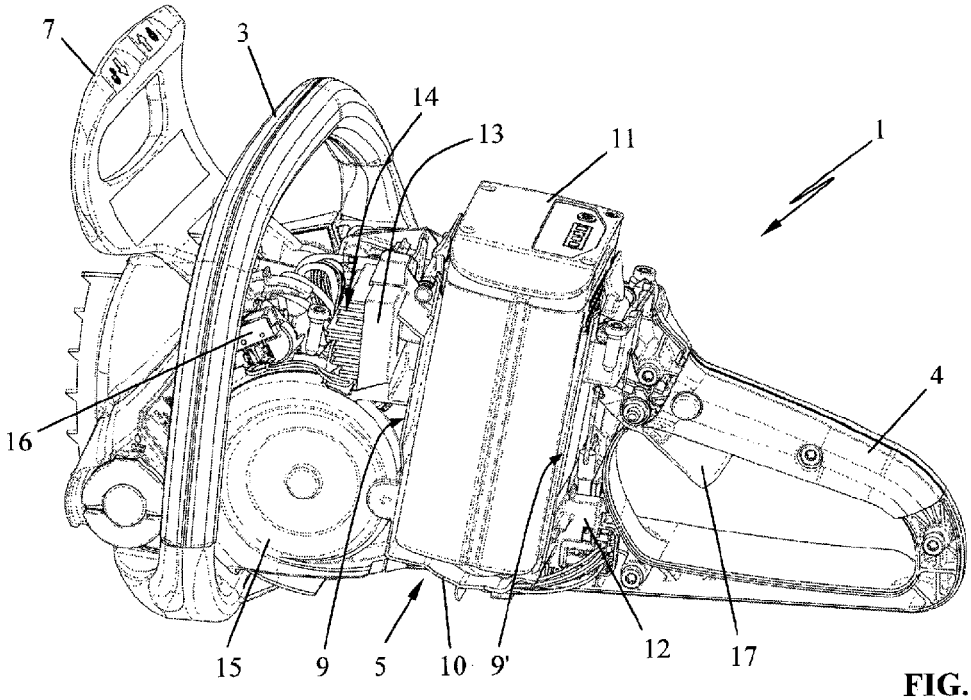
FIG. 2 shows a perspective view of the chain saw equipped with a battery pack, with the housing having been removed.

FIG. 2 shows a perspective view of the chain saw 1, wherein the housing has been removed in order to show the system carrier more clearly. It can be seen therefrom that the system carrier 5 has a base 10 from which the walls (9, 9') extend upward. In FIG. 2, a battery pack 11, which rests on the base 10, is inserted in the battery compartment which is formed between the walls (9, 9') and which is open in the upward direction. An electrical switch arrangement 12, which can also where appropriate include a controllable resistor (potentiometer), is provided on that side of the wall 9' which faces away from the battery pack 11. An electronic controller 13 having cooling ribs 14 is arranged on the wall 9 above the drive motor, which is not shown in FIG. 2.

A blower scroll 15, on which there is arranged a switch which is activated when the hand guard 7 is pressed forward, so as to interrupt the power supply to the drive motor, is also formed on the system carrier 5 in FIG. 2. This relates to a safety shutdown in particular situations when handling the work apparatus. As can also be seen in FIG. 2 the system carrier 5 includes both the receptacle for the battery pack 11 and also the switch and control elements (electrical components 12, 13, 16) which are provided for the electrical actuation of the drive motor. A throttle lever 17 is mounted on the rear handle 4 and is preferably mechanically connected to the electrical switch device 12 and where applicable also acts on the potentiometer.

Figure 3:
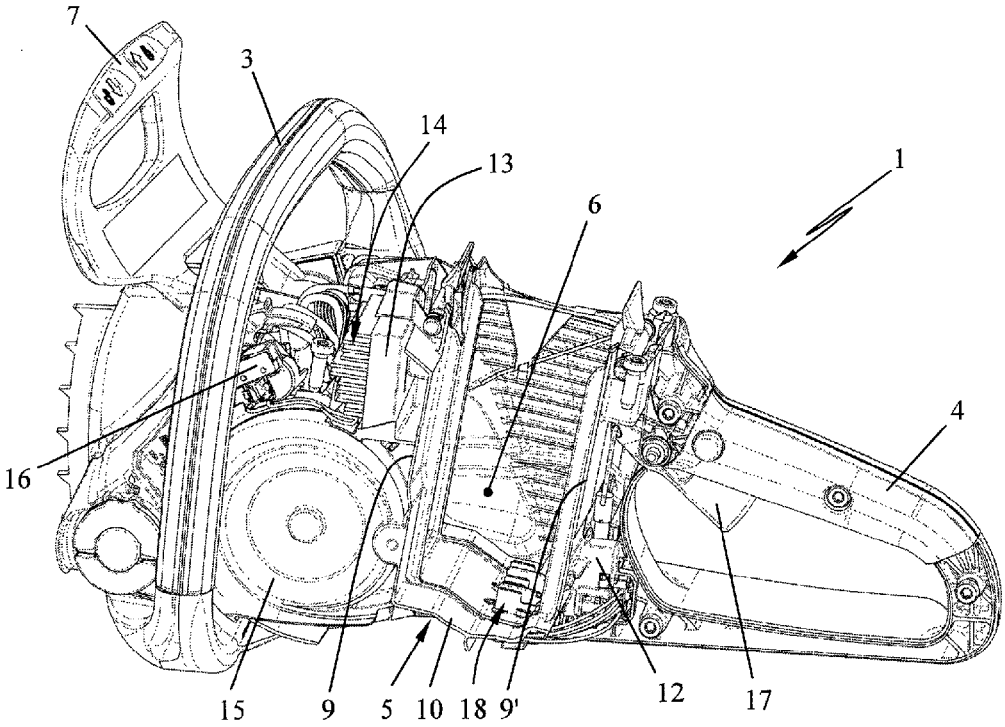
FIG. 3 shows the chain saw of FIG. 2, with the battery pack having been removed.

In FIG. 3, a chain saw 1 corresponding to the view in FIG. 2 is illustrated, but with the battery pack removed from the system carrier 5 so that the battery compartment 6, which is formed between the walls (9, 9') above the base 10, is empty. Provided on the base 10 of the system carrier 5 are contact elements 18 which, in the inserted state of the battery pack 11 shown in FIG. 2, contact electrical connections arranged on the battery pack 11.

The contact elements 18 are held on a contact plate which is mounted on the base 10 of the battery compartment 6. While the battery pack is being inserted into the battery compartment 6, the terminals of the battery pack contact the contact elements 18 in the residual distance shortly before reaching the base 10 and are brought into secure abutment. The reference numerals in FIG. 3 correspond to those in FIG. 2 for the same parts.

Figure 4:
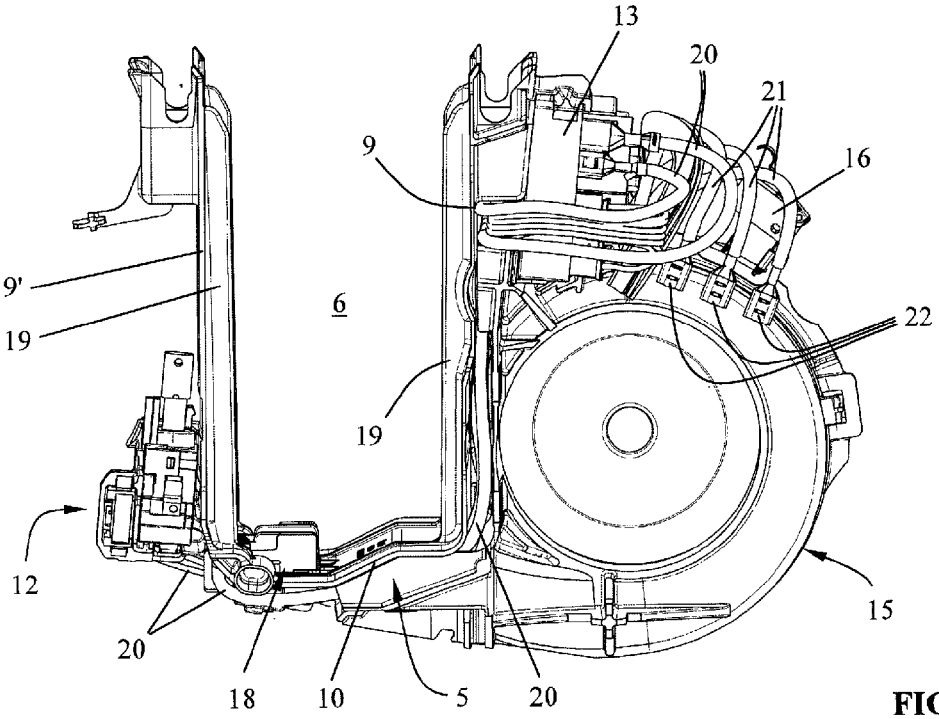
FIG. 4 shows a side view of a system carrier for switch and control elements and also for receiving the battery pack.

FIG. 4 shows a side view of the system carrier 5 with the part of the blower housing provided thereon, preferably a blower scroll 15 which, when the chain saw is fully assembled, receives an impeller fixed on the motor shaft of the drive motor. The impeller draws in a cooling air stream which serves both to cool the drive motor and to cool the electronic controller 13. On those sides of the walls (9, 9') which face each other, the walls (9, 9') have guide ridges 19, along which the battery pack is guided during insertion. This results in a gap between the walls (9, 9') and the battery pack so that a cooling of the battery pack is achieved by suitable guidance of the cooling air stream or a partial stream thereof.

It can further be seen from FIG. 4 that the base 10 and the walls (9, 9') of the carrier system 5 have essentially a U-shape, with the contact elements 18 being arranged on the base 11. The switch arrangement 12 is disposed on the wall 9' and the electronic controller 13 is attached to the wall 9. The switch 16 is disposed on the blower scroll 15. Provided between the components 12, 13 and 16 and also to the contact elements are electrical lines 20 which are attached to the system carrier 5 and can partially also be integrated therein. The electrical lines 20 are preferably combined to form a cable harness which can be built into corresponding recesses in the system carrier 5. Electrical lines 21 having connecting terminals 22 are provided for the connection of the drive motor.

Figure 5:
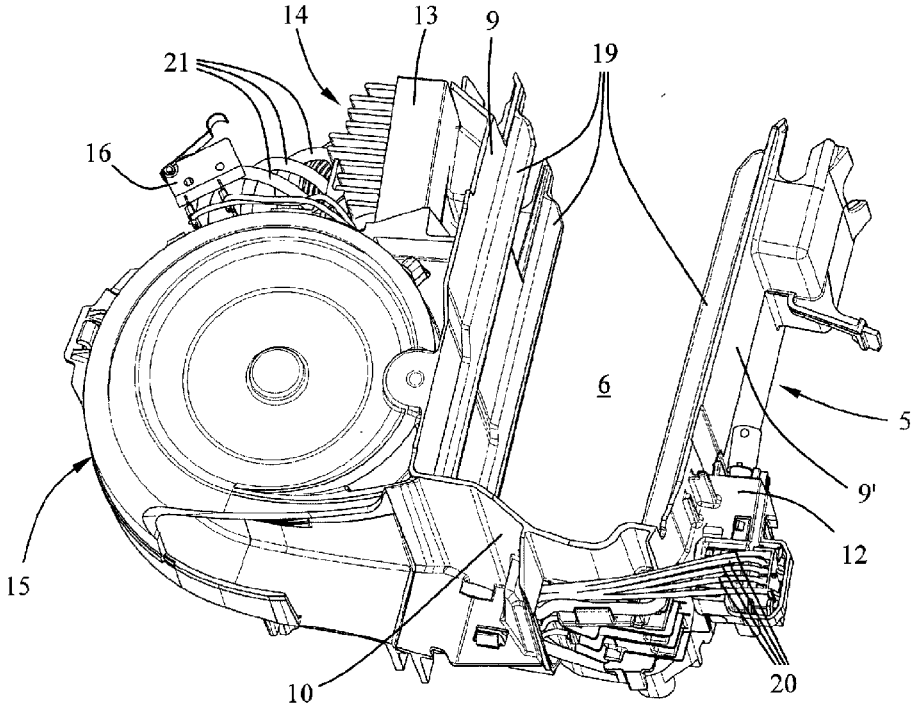
FIG. 5 shows a perspective view of the other side of the system carrier diagonally from below.

From FIG. 5, which shows a perspective view of the other side of the system carrier 5 diagonally from below, it can be seen that the blower scroll 15 includes two parts which are joined together in the axial direction. The front part in FIG. 5 is configured as one piece with the system carrier 5. A plurality of electrical lines 20, which lead to the electronic control and/or the switch 16, are connected to the switch arrangement 12. The reference numerals correspond to those in FIGS. 3 and 4 for the same parts.

Figure 6:
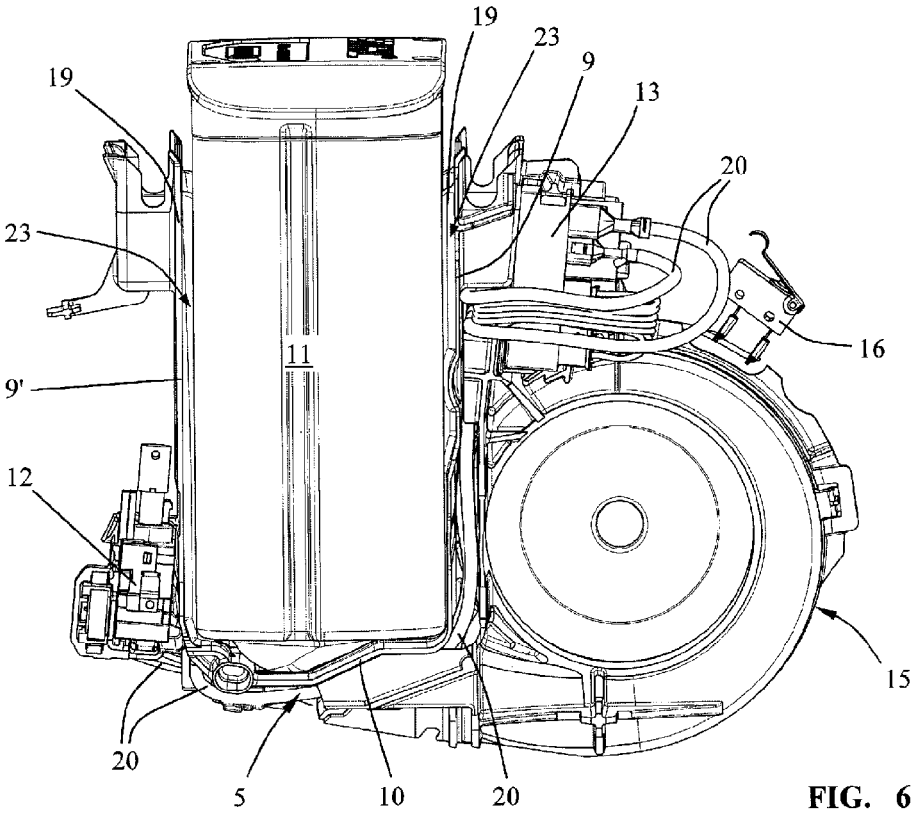
FIG. 6 shows an illustration according to FIG. 4 with a battery pack inserted.

FIG. 6 shows the system carrier 5 according to FIG. 4 with a battery pack 11 inserted in the battery compartment between the guide ridges 19. It can be seen therein that a gap 23 remains between the walls (9, 9') and the battery pack 11, it being possible for a cooling air stream to be guided through the gap 23. The reference numerals of the further components are identical to those of FIG. 4.

Figure 7:
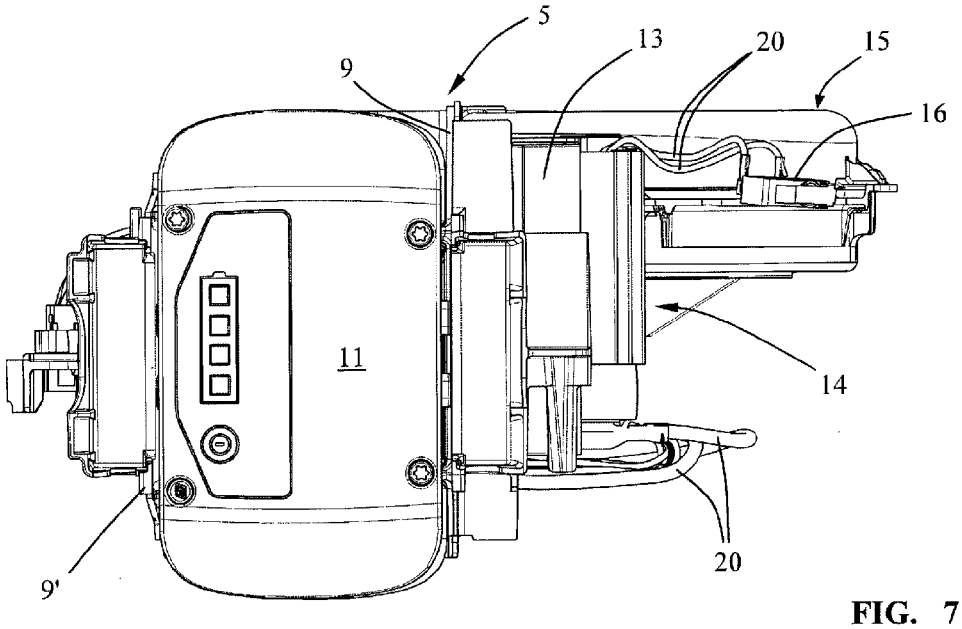
FIG. 7 shows a plan view of the arrangement according to FIG. 6.

FIG. 7 shows a plan view of the arrangement according to FIG. 6, wherein the battery pack 11 is inserted between the walls (9, 9') in the system carrier 5. The electronic controller 13 has the cooling ribs 14 and is disposed on the wall 9 and the switch 16 is disposed on the blower scroll 15. The electrical lines which can be seen in FIG. 7 are denoted by the reference numeral 20.

Figure 8:
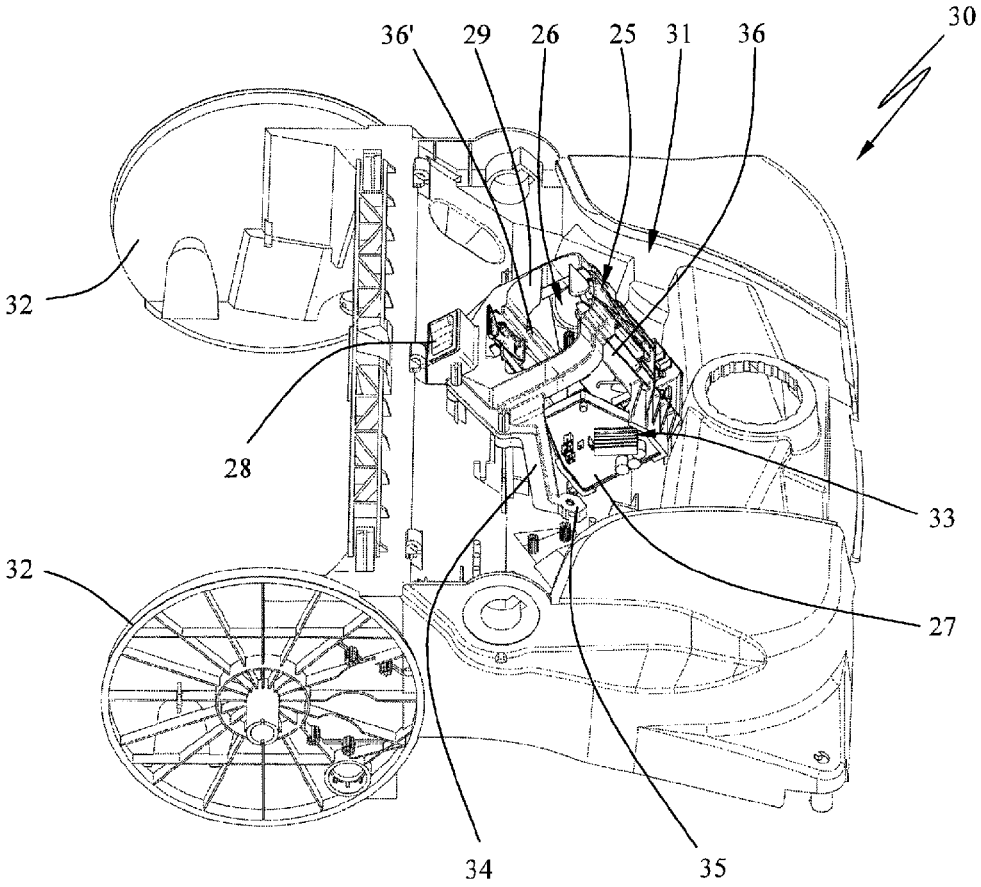
FIG. 8 shows a perspective view of a lower housing part of a sweeping appliance with a system carrier arranged therein.

The embodiment in FIG. 8 shows a perspective view of a lower housing part 31 of a sweeper 30 which is supported on wheels mounted on wheel carriers 32. The sweeper 30 is equipped with an electric drive motor which is not shown. A battery pack, as is shown, for example, in FIGS. 6 and 7 but not shown in FIG. 8, serves as the power supply unit for the drive motor. The interior of the lower housing part 31 thus forms a receiving space for the power supply unit.

A system carrier 25, which is fixed on the lower housing part 31, serves to hold the battery pack in FIG. 8. The system carrier 25 has a battery compartment 26 which is open at the top. At the lower end, the battery compartment 26 is closed by a base 27. The wall parts (36, 36') extend from the base 27 upward to a peripheral edge where a rim 29 is arranged 29 which surrounds an insertion opening. An electric switch 28, which is arranged in a receiving arrangement on the rim 29, and an electronic control 33 are disposed on the system carrier 25. Integrally formed supports 34 having fixing eyelets 35 serve for fixation on the lower housing part 31.

Figure 9:
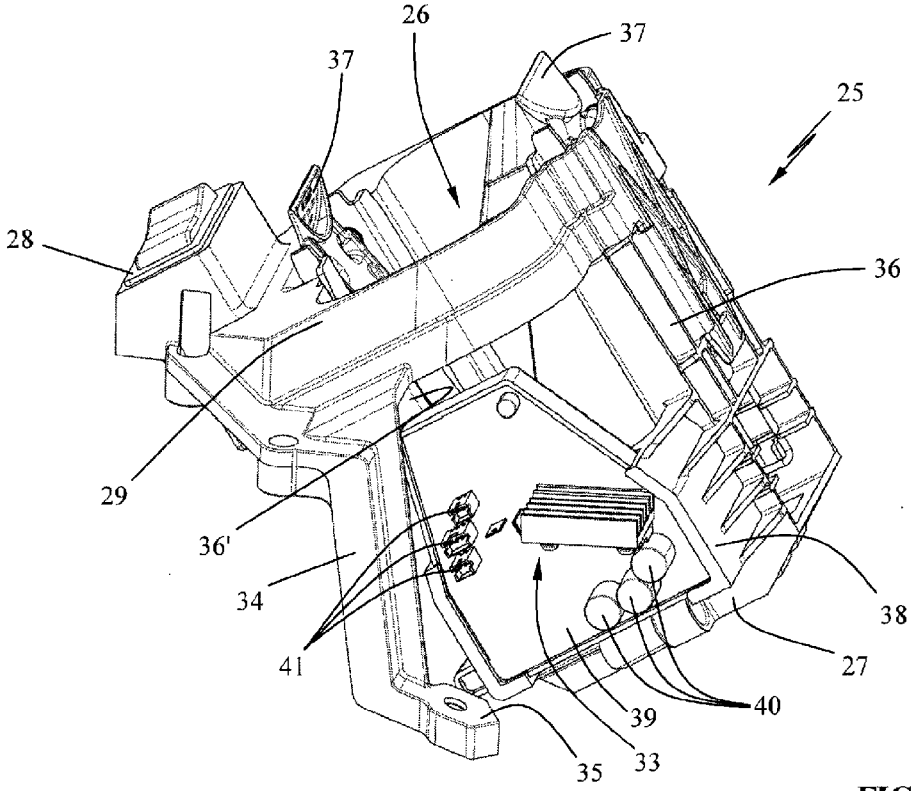
FIG. 9 shows the system carrier from FIG. 8 in an enlarged illustration.

In FIG. 9, the system carrier 25 from FIG. 8 is shown in a separate and enlarged manner. The system carrier 25 includes the two wall parts (36, 36'), which extend from the base 27 in the direction of the access opening to the battery compartment 26, and also the rim 29 on which retaining elements 37 for fixing the battery pack are arranged. A carrier plate 39 for electronic components is accommodated in a holder 38 on the front side in FIG. 9, with the electronic controller 33, switching transistors 40 and connecting plugs 41 being provided, for example, as such components. The required electrical connecting lines are formed in the carrier plate 39. The switch 28 is provided at the rim 29 and can be so configured in relation to a top part of the housing of the sweeper 30 that it is directly accessible for an operator or else can be actuated by a trigger element arranged on the top part of the housing via a mechanical connection. Starting from the rim 29, the support 34 has the fixing eyelet 35 integrally formed at its end and extends laterally next to the carrier plate 39.

Figure 10:
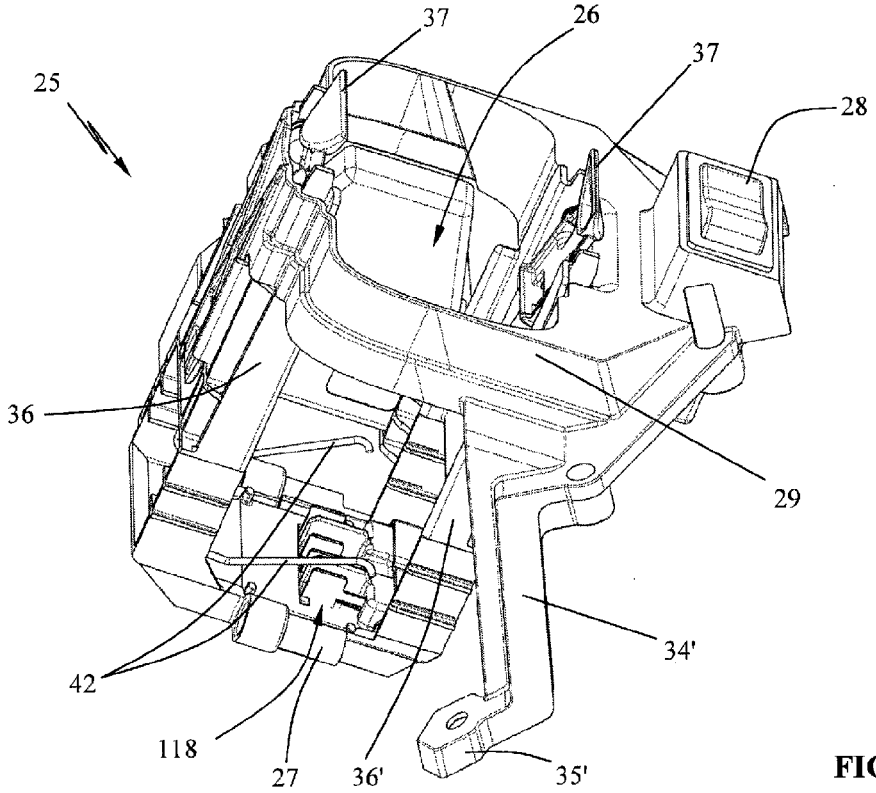
FIG. 10 shows a perspective view of the other side of the system carrier.

FIG. 10 shows a perspective view of the other side of the system carrier 25. It can be seen that a support 34', at the end of which a fixing eyelet is located, also extends from the rim 29 on this side. An opening is formed between the wall parts (36, 36') above the base 27 through which contact elements 118 located on the base 27 can be seen and are preferably arranged on a contact plate which is mounted in a floating manner. In this way, positioning imprecisions between the terminals of the battery pack and the contact elements 118 can be automatically compensated without mechanical damage occurring, but with the electrical contacting being ensured. In FIG. 10, a push-out arrangement 42 for the battery pack is also provided above the base 27 and is configured as a resilient wire bracket and pushes the battery pack up out of the battery compartment 26 by a particular length when the retaining elements 37 are released. The switch 28 is located on the peripheral edge 29 above the wall part 36'.

Figure 11:
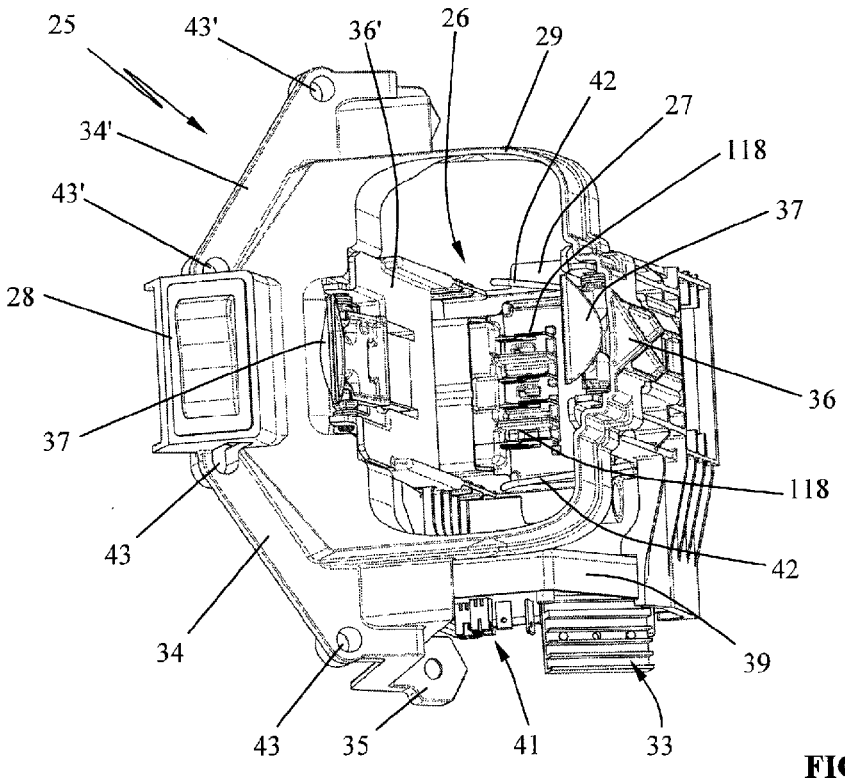
FIG. 11 shows a perspective view from above onto the system carrier.

FIG. 11 shows a perspective view from above of the system carrier 25. From FIG. 11, it can be seen that further fixation locations (43, 43') are provided on the supports (34, 34') in the form of bores in which fixation or positioning elements can be received. The contact elements 18 and the push-out arrangement 42 are located on the base 27. The electronic controller 33 having the cooling ribs and also the connecting plug 41 can be seen on the carrier plate 39. The reference numerals correspond to those in FIGS. 8 to 10 for the same parts.

Figure 12:
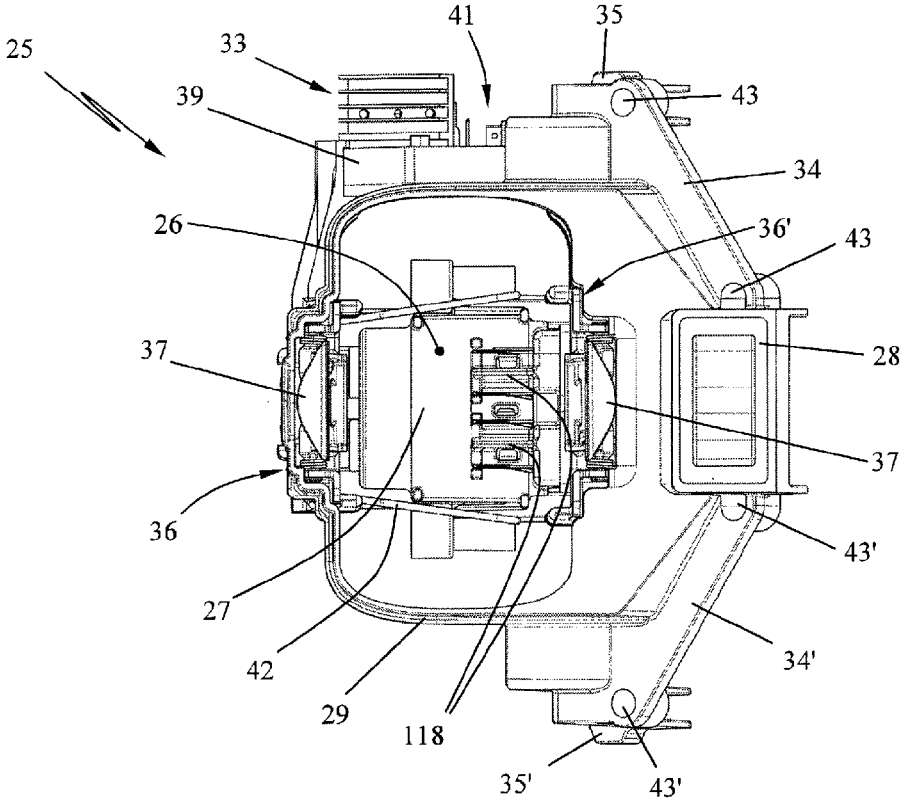
FIG. 12 shows a plan view of the system carrier.

FIG. 12 shows a plan view of the system carrier 25 which can be produced as a one-piece injection molded part. The system carrier 25 is equipped with the components, in particular switch 28, carrier plate 39 having the controller 33 and the connecting plugs 41, contact plate having contact elements 118 and the required electrical connecting lines. The push-out arrangement 42 is also inserted. The reference numerals for the further elements are taken over from those in FIGS. 8 to 11, and so reference is made to the above description to avoid repetition in this respect. In the embodiment of FIGS. 8 to 12, all electrical lines for connecting the electrical components, such as contact elements 118, switch 28, electronic control 33 are relocated to within the system carrier 25 and therefore cannot be seen in FIGS. 8 to 12.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

an electric drive motor;

a battery pack configured as a power supply unit for said drive motor;

a housing having a receiving space;

a receiver arranged on said housing and being configured to receive said battery pack;

a system carrier arranged in said receiving space;

a plurality of electrical components attached to said system carrier;

a plurality of electrical lines attached to said system carrier;

said system carrier having a battery compartment formed therein;

a plurality of contact elements arranged on said system carrier and being configured to contact said battery pack;

said electrical lines being configured to interconnect said electrical components and connect the same with said contact elements;

said system carrier having a base and two parallel walls projecting up from said base;

said walls being configured to define said battery compartment;

said electrical components including an electronic control and a switch arrangement;

said walls having respective first ends facing away from said base;

a rim arranged along a peripheral edge of said first ends and said rim surrounding an insertion opening of said battery compartment; and, said handheld work apparatus further comprising a receiving unit arranged on said rim and configured to receive said switch arrangement.

2. A handheld work apparatus comprising:

an electric drive motor;

a battery pack configured as a power supply unit for said drive motor;

a housing having a receiving space;

a receiver arranged on said housing and being configured to receive said battery pack;

a system carrier arranged in said receiving space;

a plurality of electrical components attached to said system carrier;

a plurality of electrical lines attached to said system carrier;

said system carrier having a battery compartment formed therein;

a plurality of contact elements arranged on said system carrier and being configured to contact said battery pack;

said electrical lines being configured to interconnect said electrical components and connect the same with said contact elements;

said system carrier having a base and two parallel walls projecting up from said base;

said walls being configured to define said battery compartment;

said base and said two walls together defining a U-shape;

said walls having respective first ends facing away from said base; and, a rim arranged along a peripheral edge of said first ends and said rim surrounding an insertion opening of said battery compartment.

3. The handheld work apparatus of claim 2, wherein said system carrier is made of plastic and is configured as a one-piece injection molded part.

4. The handheld work apparatus of claim 3, wherein:

said system carrier has a plurality of recesses;

at least some of said electrical lines are pooled in a cable harness; and, said cable harness is at least partially arranged in said recesses of said system carrier.

5. The handheld work apparatus of claim 2, further comprising:

a blower housing configured to receive a blower wheel; and, said blower housing being formed in part on said system carrier.

6. The handheld work apparatus of claim 2, wherein said walls have respective sides facing each other, said handheld work apparatus further comprising:

guide ridges arranged on said sides of said walls; and, said guide ridges being configured to define a gap between said battery pack and said walls.

7. The handheld work apparatus of claim 2 further comprising retaining elements arranged at said first ends of said walls and being configured for fixing said battery pack.

8. The handheld work apparatus of claim 2, wherein said electrical components include an electronic control and a switch arrangement.

9. The handheld work apparatus of claim 8, wherein:

said system carrier has a carrier plate on which said electronic control is arranged; and, said carrier plate has a connecting plug.

10. The handheld work apparatus of claim 8, further comprising:

a back handle arranged on said housing;

a throttle lever mounted in said back handle; and, said throttle lever being mechanically connected to said switch arrangement.

11. The handheld work apparatus of claim 8, said handheld work apparatus further comprising a receiving unit arranged on said peripheral edge and configured to receive said switch arrangement.

12. The handheld work apparatus of claim 2, wherein said system carrier has additional electrical lines having connection terminals configured to connect to said drive motor.

13. The handheld work apparatus of claim 2, further comprising:

a hand guard; and, said electrical components including a switch configured to interrupt the power supply from said battery pack when said hand guard is activated.

14. The handheld work apparatus of claim 2, wherein:

said battery compartment has a base;

said contact elements configured for contacting said battery pack are arranged on said base.

15. The handheld work apparatus of claim 2, further comprising:

a contact plate;

said battery compartment having a base;

said contact plate being mounted on said base in a floating manner; and, said contact elements being arranged on said contact plate.

16. The handheld work apparatus of claim 2, further comprising stubs formed on said peripheral edge, said stubs having fixing eyelets at their free ends.

17. The handheld work apparatus of claim 3, further comprising a push-out unit configured for said battery pack arranged on said base of said battery compartment.

* * * * *

UNITED STATES PATENT AND TRADEMARK OFFICE

CERTIFICATE OF CORRECTION

PATENT NO. : 8,757,288 B2
APPLICATION NO. : 13/229869
DATED : June 24, 2014
INVENTOR(S) : Georg Heinzelmann et al.

It is certified that error appears in the above-identified patent and that said Letters Patent is hereby corrected as shown below:

In the Claims:

In column 8:

Line 18: delete "peripheral edge" and substitute -- rim -- therefor.

Line 41: delete "peripheral edge" and substitute -- rim -- therefor.

Signed and Sealed this
Seventh Day of October, 2014

Michelle K. Lee

Michelle K. Lee
*Deputy Director of the United States Patent and Trademark Office*